US010704201B2

(12) United States Patent
Zhao et al.

(10) Patent No.: US 10,704,201 B2
(45) Date of Patent: Jul. 7, 2020

(54) DRY STRENGTH AGENT COMPOSITION AND METHOD FOR ENHANCING THE DRY STRENGTH OF PAPER

(71) Applicant: ECOLAB USA INC., St. Paul, MN (US)

(72) Inventors: Yulin Zhao, Shanghai (CN); Chunhao Wang, Shanghai (CN); Na Xu, Shanghai (CN); Jun Li, Shanghai (CN); Meng Zhang, Shanghai (CN)

(73) Assignee: ECOLAB USA INC., St. Paul, MN (US)

( * ) Notice: Subject to any disclaimer, the term of this patent is extended or adjusted under 35 U.S.C. 154(b) by 22 days.

(21) Appl. No.: 15/773,667

(22) PCT Filed: Dec. 30, 2016

(86) PCT No.: PCT/CN2016/113329

§ 371 (c)(1),
(2) Date: May 4, 2018

(87) PCT Pub. No.: WO2017/114478

PCT Pub. Date: Jul. 6, 2017

(65) Prior Publication Data

US 2018/0320316 A1 Nov. 8, 2018

(30) Foreign Application Priority Data

Dec. 31, 2015 (CN) ..... 2015 1 1025285

(51) Int. Cl.

| | |
|---|---|
| ***D21H 17/26*** | (2006.01) |
| ***D21H 21/18*** | (2006.01) |
| ***D21H 17/45*** | (2006.01) |
| ***D21H 17/42*** | (2006.01) |
| ***D21H 27/10*** | (2006.01) |
| ***D21H 17/44*** | (2006.01) |
| ***D21H 17/47*** | (2006.01) |
| ***D21H 17/56*** | (2006.01) |
| ***D21H 17/37*** | (2006.01) |
| ***D21H 17/36*** | (2006.01) |
| ***D21H 17/43*** | (2006.01) |

(52) U.S. Cl.

CPC ..... *D21H 21/18* (2013.01); *D21H 17/26* (2013.01); *D21H 17/36* (2013.01); *D21H 17/37* (2013.01); *D21H 17/375* (2013.01); *D21H 17/42* (2013.01); *D21H 17/43* (2013.01); *D21H 17/44* (2013.01); *D21H 17/45* (2013.01); *D21H 17/47* (2013.01); *D21H 17/56* (2013.01); *D21H 27/10* (2013.01)

(58) Field of Classification Search

USPC ..... 162/164.6

See application file for complete search history.

(56) References Cited

U.S. PATENT DOCUMENTS

| | | | |
|---|---|---|---|
| 3,902,958 | A | 9/1975 | Breen et al. |
| 2005/0161181 | A1 | 7/2005 | St. John et al. |
| 2008/0196851 | A1 | 8/2008 | Hund et al. |
| 2012/0073773 | A1 | 3/2012 | Jehn-Rendu et al. |
| 2012/0118523 | A1 | 5/2012 | Lu et al. |
| 2016/0222590 | A1 | 8/2016 | Zhu et al. |
| 2016/0230346 | A1 | 8/2016 | Zhu et al. |
| 2016/0273167 | A1 | 9/2016 | Zhang et al. |

FOREIGN PATENT DOCUMENTS

| | | | |
|---|---|---|---|
| CN | 1914375 | A | 2/2007 |
| CN | 102648254 | A | 8/2012 |
| CN | 104452455 | A | 3/2015 |
| CN | 104452463 | A | 3/2015 |
| CN | 104592441 | A | 5/2015 |
| EP | 2917406 | B1 | 1/2017 |

OTHER PUBLICATIONS

International Search Report and Written Opinion for corresponding International Application No. PCT/CN2016/113329, 7 pages (dated Apr. 1, 2017).

*Primary Examiner* — Mark Halpern

(74) *Attorney, Agent, or Firm* — Eric D. Babych; Barnes & Thornburg LLP

(57) ABSTRACT

The present disclosure relates to a dry strength agent composition, use of an amine-containing cationic polymer for enhancing the dry strength of paper, and a method for enhancing the dry strength of paper. The dry strength agent composition includes at least two components. The first component is an amine-containing cationic polymer and the second component may be one or more anionic or amphoteric polymers.

20 Claims, 1 Drawing Sheet

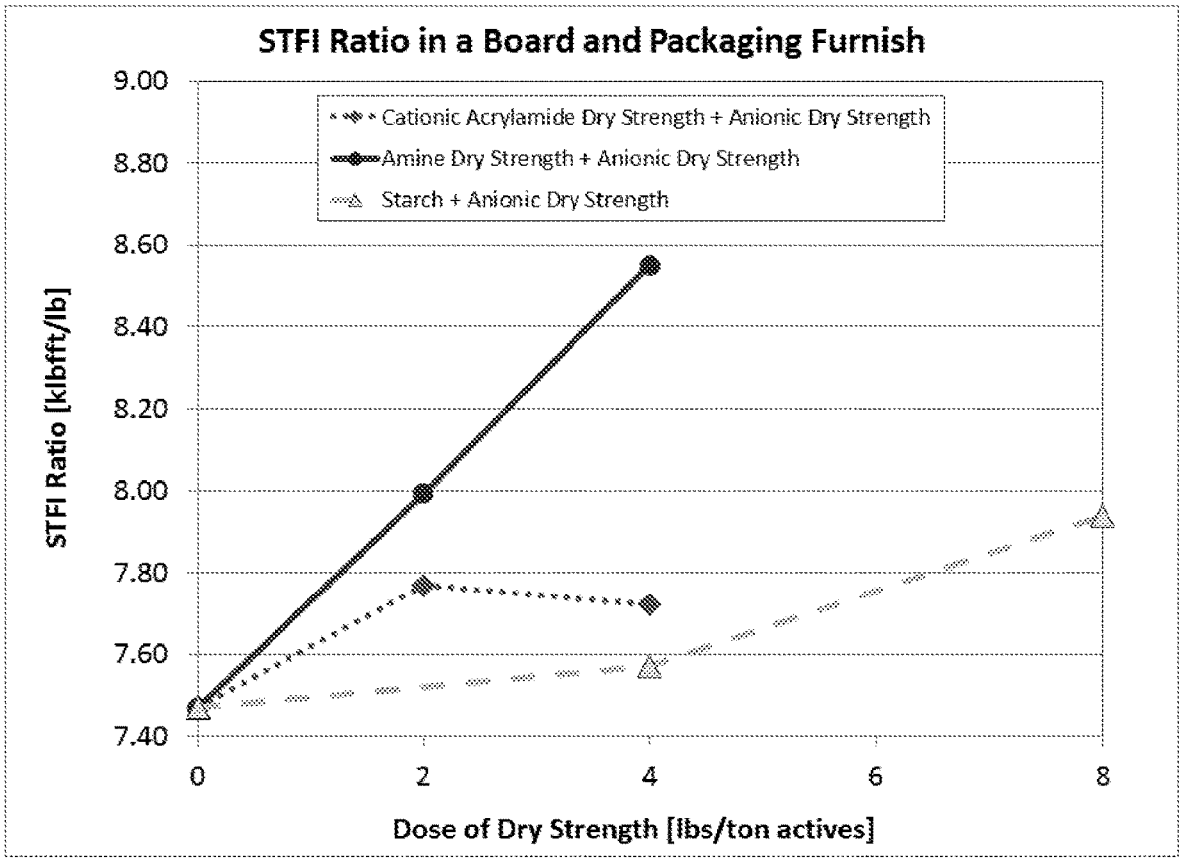
STFI Ratio in a Board and Packaging Furnish
Cationic Acrylamide Dry Strength + Anionic Dry Strength
Amine Dry Strength + Anionic Dry Strength
Starch + Anionic Dry Strength
STFI Ratio [klbfft/lb]
9.00
8.80
8.60
8.40
8.20
8.00
7.80
7.60
7.40
0
2
4
6
8
Dose of Dry Strength [lbs/ton actives]

DRY STRENGTH AGENT COMPOSITION AND METHOD FOR ENHANCING THE DRY STRENGTH OF PAPER

This application is a 371 of PCT/CN2016/113329 filed 30 Dec. 2016.

TECHNICAL FIELD

The present disclosure relates to a dry strength agent composition and the use of an amine-containing cationic polymer for enhancing the dry strength of paper.

BACKGROUND

A typical papermaking process includes the steps of: 1) pulping wood or some other source of papermaking fibers; 2) producing a paper mat from the pulp, the paper mat being an aqueous slurry of cellulosic fiber which may also contain additives such as inorganic mineral fillers or pigments; 3) depositing this slurry on a moving papermaking wire or fabric; 4) forming a sheet from the solid components of the slurry by draining the water; 5) pressing and drying the sheet to further remove water, and 6) potentially rewetting the dry sheet by passing it through a size press and further drying it to form a paper product.

When conducting a papermaking process, a number of concerns need to be taken into account to assure the quality of the final paper product. For example, when draining the water from the slurry, fibers and chemical additives should be retained as much as possible instead of flowing away with the water. Similarly, the final sheet should have adequate wet strength and dry strength. The dry strength of paper generally includes, for example, internal bonds, dry tensile strength, and burst strength.

U.S. Pat. Nos. 8,465,623, 7,125,469, 7,615,135 and 7,641,776, which are incorporated herein by reference in their entirety, present some materials that could be used as dry strength agents. These agents can be added to the slurry to increase the strength properties of the final sheet. These agents should be capable of improving the paper machine drainage without interfering or hurting the effectiveness of other additives added in paper making process.

Commonly used dry strength agents include natural polymers, such as cationic starch, carboxymethyl cellulose (CMC) and guar gum, and synthetic polymers, such as polyacrylamide (cationic, anionic and amphoteric), glyoxalated polyacrylamides (GPAMs), and polyvinylamines. In the category of di-aldehyde functionalized polyacrylamide, glyoxalated polyacrylamide (GPAM), prepared from glyoxal and a polyacrylamide backbone, is the most commonly used dry strength agent.

Anionic, amphoteric, and cationic di-aldehyde functionalized polyacrylamides (mostly GPAMs) can usually be used alone (see, for example, WO 00/11046, U.S. Pat. Nos. 7,641,766, and 7,901,543, all of which are incorporated herein by reference in their entirety). However, single dry strength agents usually can't meet all necessary requirements so complex dry strength agents are being developed. For example, U.S. Patent Application Publication No. 2008/0196851, which is incorporated herein by reference, provides a method for improving the dry strength of paper in which a composition comprising at least two kinds of dry strength agents is used. The first dry strength agent corresponds to a Hoffmann degradation product deriving from a base polymer containing at least one non-ionic monomer while the second dry strength agent corresponds to a polymer with an anionic charge density greater than 0.1 meq/g. However, the product cost is high because of the usage of a Hoffmann degradation product, which is prepared by a complicated process.

BRIEF SUMMARY

In at least one embodiment of the present disclosure, a dry strength agent composition is provided. The composition comprises at least two components. The first component is an amine-containing cationic polymer and the second component is one or more polymer(s) selected from anionic, amphoteric and uncharged polymers and/or a natural macromolecular compounds. In certain embodiments, the second component comprises an anionic polymer and/or an amphoteric polymer.

Additional embodiments of the present disclosure relate to the use of a composition for improving the dry strength of paper, wherein the composition comprises an amine-containing cationic polymer and an anionic polymer and/or an amphoteric polymer.

In still other embodiments, the present disclosure provides methods for enhancing the dry strength of paper in the papermaking process.

BRIEF DESCRIPTION OF THE DRAWING FIGURE

FIG. 1 depicts a graph showing the amine dry strength chemisty/anionic polymer combination performing better than a standard cationic dry strength chemistry/anionic polymer combination.

DETAILED DESCRIPTION

The present disclosure relates to dry strength agent compositions and methods of increasing the dry strength of a paper sheet or substrate. The inventors unexpectedly discovered that by adding a dry strength agent composition comprising a first amine-containing cationic polymer and a second anionic and/or amphoteric polymer at one or more feeding points of the papermaking process, the dry strength of paper can be surprisingly enhanced to a much higher level than by using each of the components alone.

The first component of the inventive dry strength agent composition is an amine-containing cationic polymer. The representative amine-containing polymer may have a molecular weight greater than about 5,000 g/mol, preferably greater than about 10,000 g/mol, but preferably below about 5,000,000 g/mol, more preferably below about 2,000,000 g/mol. At least about 1 mol % and up to about 99 mol %, preferably about 5 to about 80 mol % and more preferably about 10 to about 60 mol % of monomers of the polymer are polymerized secondary amine-containing monomers, such as secondary amine-containing vinyl or allyl monomers. The amine-containing cationic polymer may have the cationic charge density greater than about 0.1 and below about 23 meq/g, such as between about 0.3 and about 15 meq/g. In some embodiments, the amine-containing cationic polymers have molecular weights from about 200,000 to about 1,500,000 g/mol.

In certain embodiments, the amine-containing cationic polymer includes a polymer with randomly distributed amine-based monomer repeating units derived from at least one of the following structures: Formulae I, II and/or the salt forms thereof:

I

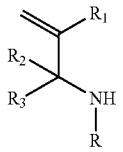

II

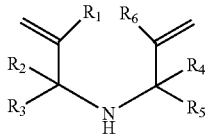

wherein R can be hydrogen or $C_{1-20}$ alkyl; $R_1$, $R_2$, $R_3$, $R_4$, $R_5$, $R_6$ are independently selected from hydrogen, $C_{1-20}$ alkyl, or $C_{1-20}$ alkoxylalkyl. In certain embodiments, groups R, $R_1$, $R_2$, $R_3$, $R_4$, $R_5$, $R_6$ are independently selected from $C_{1-10}$ alkyl, preferably $C_{1-3}$ alkyl, more preferably methyl or ethyl.

In other embodiments, at least about 1 to about 99 mol %, preferably about 10 to about 80 mol %, more preferably about 10 to about 60 mol % of monomers of the polymer, based on the amine-containing polymer, are secondary amine-containing vinyl- or allyl-monomers, such as the amine-based monomers of the above formulae I, II and/or salt forms thereof.

Regarding the salt forms of formulae I and II, mono- or di-valent metal salts or ammonium salts, such as alkali metal salts or earth alkali metal salts or ammonium salts, may be used.

Preferably, the amine-based monomers are diallyl amines or substituted diallyl amines, such as those of formula II. In addition to the monomers of formulae I, II and/or salt forms thereof, the amine-containing polymers according to the present disclosure may comprise at least one vinyl addition monomer including non-ionic and cationic co-monomers. Preferably, the amine-containing polymers according to the present disclosure are formed by the monomers of formulae I, II and/or salt forms thereof and non-ionic co-monomers, or by the monomers of formulae I, II and/or salt forms thereof, non-ionic co-monomers and cationic co-monomers. The amount of the non-ionic co-monomers may vary between about 1 to about 99 mol %, based on the amine-containing copolymer.

Representative non-ionic co-monomers include acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, similar monomers, and combinations thereof. In certain embodiments, the non-ionic co-monomer is acrylamide or methacrylamide.

Representative cationic co-monomers may include for example dialkylaminoalkyl acrylates and methacrylates and their quaternary or acid salts, including, but not limited to, dimethylaminoethyl acrylate methyl chloride quaternary salt ("DMAEA-MCQ"), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride and diallyldimethyl ammonium chloride ("DADMAC"), similar monomers, and combinations thereof. When present, alkyl groups are generally $C_1$ to $C_4$ alkyl.

Furthermore, in certain embodiments, the preferable cationic monomers are one or more selected from the group consisting of diallyldimethyl ammonium chloride, N-(3-dimethylaminopropyl)acrylamide, N-(3-dimethylaminopropyl)methacrylamide, N-(3-dimethylaminoethyl)acrylamide, N-(3-dimethylaminoethyl)methacrylamide, trimethyl-2-acryloyloxyethyl ammonium chloride, trimethyl-2-methacryloyloxyethyl ammonium chloride, 2-(dimethylamino) ethyl acrylate and 2-(dimethylamino)ethyl methacrylate.

Generally, the amine-containing polymers used in accordance with this disclosure may take the form of water-in-oil emulsions, dry powders, dispersions, or aqueous solutions. In certain embodiments, the amine-containing polymers may be prepared via free radical polymerization techniques in water using free radical initiation.

In some embodiments, the amine-containing polymer is a copolymer formed by diallylamine/substituted diallylamine and (meth) acrylamide, preferably a diallylamine-(meth) acrylamide copolymer ("DAA/AcAm"). Moreover, it is also possible to use the mixture of one or more copolymers formed by diallylamine/substituted diallylamine and (meth) acrylamide as the amine-containing polymer.

The inclusion of amine-based monomers, such as diallylamine, in the amine-containing polymer may be an important variable when treating paper according to this disclosure. In certain embodiments, the mole percentage of said amine-based monomers (e.g., diallylamine) in the inventive amine-containing polymer, such as diallylamine-(meth) acrylamide copolymer, can be within a range of about 1 to about 99%. The amine-containing polymer may be primarily made up of amine-based monomers, i.e., may comprise more amine-based monomer units than other co-monomer units, such as (meth)acrylamide. In those embodiments, where cost is a deciding factor in terms of composition of the oil-in-water emulsion, the mole percentage of amine-based monomers in the amine-containing polymer may be from about 10 to about 80, about 15 to about 60 or about 18 to about 40%. In certain embodiments, the amine-containing polymers of the present disclosure are not obtained from Hoffmann degradation and contain no polyethylene amine units.

The second component of the dry strength agent composition according to the present disclosure is a polymer selected from anionic, amphoteric and uncharged polymers and/or a natural macromolecular compound which is different from the first component. In certain embodiments, the second component is selected from the group consisting of anionic polymers, amphoteric polymers, and any combination thereof.

The anionic polymers used in the second component may be acrylamide copolymers formed from one or more acrylamide monomers and one or more anionic monomers. The anionic charge density may be at or above about 0.1 meq/g. "Acrylamide monomer" means the monomer of formula

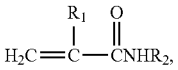

wherein $R_1$ is H or $C_1$-$C_4$ alkyl and $R_2$ is H, $C_1$-$C_4$ alkyl, aryl or arylalkyl. Preferably, acrylamide monomers are, for example, acrylamide or methacrylamide. "Alkyl" means a monovalent group derived from a straight or branched chain saturated hydrocarbon by the removal of a single hydrogen atom. Representative alkyl groups include methyl, ethyl, n- and iso-propyl, cetyl, and the like. "Alkylene" means a divalent group derived from a straight or branched chain saturated hydrocarbon by the removal of two hydrogen atoms. Representative alkylene groups include methylene, ethylene, propylene, and the like. "Aryl" means an aromatic monocyclic or multicyclic ring system of about 6 to about 10 carbon atoms. The aryl is optionally substituted with one or more $C_1$-$C_{20}$ alkyl, alkoxy or haloalkyl groups. Representative aryl groups include phenyl or naphthyl, or substituted phenyl or substituted naphthyl. "Arylalkyl" means an arylalkylene-group where aryl and alkylene are as defined above. Representative arylalkyl groups include benzyl, phenylethyl, phenylpropyl, 1-naphthylmethyl, and the like, such as benzyl.

The anionic monomer is not particularly limited. The anionic monomer can be one or more selected from a group consisting of acrylic acid, methacrylic acid, itaconic acid, maleic acid, maleic anhydrid, allyl sulfonic acid, methyl allylsulfonic acid, 1-acrylamido-2-methyl-1-propane sulfonic acid and the salts thereof. Preferably, the anionic monomer is acrylic acid, methacrylic acid, allyl sulfonic acid, methyl allylsulfonic acid, 1-acrylamido-2-methyl-1-propane sulfonic acid and corresponding salts thereof.

There is also no particular limitation on the amount of the anionic monomers, as long as a stable polymer is prepared. For example, the amount of the anionic monomers can be about 0.1 to about 50 mol %, such as about 5 to about 30 mol %, of the copolymer, depending on the practical application.

The amphoteric polymers of the second component may comprise acrylamide copolymers formed by one or more acrylamide monomers, one or more cationic monomers and one or more anionic monomers. In certain embodiments, the total charge of the amphoteric polymers is positive and the cationic charge density is from about 0.1 to about 23 meq/g, such as from about 0.3 to about 15 meq/g. The acrylamide monomers and anionic monomers are defined as above, while the cationic monomers include those amine-based monomers as mentioned under the amine-containing cationic polymers and also cationic monomers including quaternary ammonium salts.

Preferably, the cationic monomers can be one or more selected from the group consisting of methacryloyloxyethyl trimethylammonium chloride, acryloyloxyethyl trimethylammonium chloride, methacryloyloxyethyl dimethylbenzyl ammonium chloride, acryloyloxyethyl dimethylbenzyl ammonium chloride, (3-acrylamidopropyl)trimethylammonium chloride, methacrylamidopropyl trimethylammonium chloride, 3-acrylamido-3-methylbutyl trimethylammonium chloride, 2-vinyl pyridine, 2-(dimethylamino)ethyl methacrylate, 2-(dimethylamino)ethyl acrylate, diallyl amine, triallyl amine, diallyl dimethyl ammonium chloride, N-(3-dimethylaminopropyl)acrylamide, N-(3-dimethylaminopropyl)methacrylamide, N-(3-dimethylaminoethyl)acrylamide, N-(3-dimethylaminoethyl)methacrylamide, trimethyl-2-acryloyloxyethyl ammonium chloride, trimethyl-2-methacryloyloxyethyl ammonium chloride, 2-(dimethylamino) ethyl acrylate and 2-(dimethylamino)ethyl methacrylate.

Depending on the application, the sum amount of cationic monomers and/or anionic monomers can be about 0.1 to about 50 mol %, such as about 5 to about 30 mol % of the copolymer, without limitation.

Furthermore, there is no limitation to the ratio between cationic monomers and anoinic monomers in the amphoteric polymers. Depending on the application, for example, the molar ratio of cationic monomers to anionic monomers may be from about 1:100 to about 100:1, such as about 1:10 to about 10:1, without limitation.

Preferably, the amphoteric polymers are polymers formed from acrylic acid, (meth)acrylamide, N-(2-dimethylaminoethyl)acrylamide, diallyl dimethyl ammonium chloride, monovalent metal salts or ammonium salt of acrylic acid, allyl sulfonic acid and/or monovalent metal salts or ammonium salt of allyl sulfonic acid, such as sodium allyl sulfonate.

The second component may further comprise uncharged polymers, such as polyvinyl alcohol and polyvinyl pyrrolidone.

The natural macromolecular components may be used alone or in combination with the polymers as described above in the second component. The natural macromolecular compounds suitable for the present disclosure may include carboxymethyl cellulose and/or anionic starch. In certain embodiments, the substitution degree of the anionic starch may vary between about 0.01 to about 0.3.

In other embodiments, the second component may be further crosslinked by dialdehyde compounds. The dialdehyde compounds, without any specific limitation, may be chosen from glyoxal, malondialdehyde, succinaldehyde and glutaraldehyde, preferably glyoxal. In the dry strength agent composition according to the present disclosure, it is possible to use the product directly after dialdehyde functionalization as the second component, or use the mixture of the dialdehyde functionalized product with the non-dialdehyde functionalized product as the second component. In this disclosure, there is no limitation to the ratio (G/A ratio) between the dialdehydes, in particular glyoxal and the non-ionic monomers, such as acrylamide monomers in the dialdehyde modified polymers, which may range from about 0.01:1 to about 1:1 by mole, such as from about 0.1:1 to about 0.8:1 by mole.

WO 00/11046, the contents of which are incorporated into the present application in their entirety, discloses a method for preparing dialdehyde modified polymers that are suitable for use in accordance with the present disclosure, based on which the person of ordinary skill in the art can obtain the dialdehyde modified first component and second component according to the disclosure.

In the dry strength agent composition according to the present disclosure, the weight ratio between the two components (i.e., first component:second component) may range from about 1:99 to about 99:1, preferably from about 1:10 to about 10:1, and more preferably from about 1:3 to about 5:1, based on the active ingredients.

Depending on the requirement, in addition to the first component and second component, the dry strength agent composition may contain (or may exclude) other chemical aids for papermaking, especially synthetic polymer aids for papermaking, such as urea-formaldehyde resin, melamine formaldehyde resin, polyethyleneimine (PEI), polyethylene oxide (PEO), aluminum sulfate, and retention aids, such as a copolymer of diallyldimethyl ammonium chloride with acrylamide. The dry strength agent composition according to the disclosure may contain (or may exclude) other dry strength agents. In the case that the dry strength agent composition contains other chemical aids for papermaking, those skilled in the art can select the suitable kinds and amounts of the other chemical aids. The amount of the other chemical aids may, for example, be in the range of about 0 to about 50% by mass, preferably about 0 to about 20% by mass, and more preferably from about 0 to about 5% by mass.

Further, the dry strength agent composition may only comprise the combination of the first and second components as described above and water as a medium.

As described above, other aspects of the present disclosure provide methods for enhancing the dry strength of paper in the papermaking process. In some embodiments, the methods include the steps of:

(a) providing a pulp slurry; simultaneously or before or after (b) providing the above dry strength agent composition;

(c) adding the dry strength composition into the paper slurry to obtain a paper stock.

In the method for enhancing the dry strength of paper, the feeding manner of the dry strength agent composition includes, but is not limited to, adding the components separately into the pulp slurry in any sequence, or adding into the pulp slurry after premixing the components or co-feeding the components into the pulp slurry.

In some embodiments, the dry strength agent composition according to the disclosure is added into the pulp slurry before the papermaking from the pulp slurry.

In certain embodiments, the dry strength agent composition may be used in an amount of about 0.01 to about 50 kg/t, preferably about 0.2 to about 10 kg/t absolute dry pulp, based on the active ingredients.

EXAMPLES

Aspects of the present disclosure are further illustrated by the following examples, which are not intended to limit the scope of the disclosure.

Example 1

First component: Copolymer of diallyl and acrylamide (referred to as C1) with the number-average molecular weight of about 500,000 g/mol and the cationic charge density of about 4.2 meq/g, wherein the molar ratio of diallyl amine to acrylamide is about 35:65.

Second component: Anionic copolymer of acrylic acid and acrylamide with the number-average molecular weight of about 500,000 g/mol and the anionic charge density of about 0.96 meq/g, referred to as A1.

Concentrated pulp was obtained from the paper mill, which, after cooling, was diluted to the solid content of about 0.7% with mill white water.

Composition of the pulp: 75% of Old Corrugated Cardboard (OCC) and 25% of American Old Corrugated Cardboard (AOCC).

A certain amount of pulp slurry was weighed and each kind of chemical agent was added into the pulp every 15 seconds under the agitation with 800 rpm. The chemical agents were added in the following sequence: cationic starch (5 kg/t), aluminium sulphate (2 kg/t), dry strength agent, and the retention aid the copolymer of diallyldimethyl ammonium chloride with acrylamide (0.3 kg/t).

The obtained paper sample was placed overnight under constant temperature and humidity (23° C. and 50% RH). All hand sheets were prepared according to Standard TAPPI T205. Internal bond was measured according to Standard TAPPI T569 by determining the Scott bond of paper sheet. The dry tensile strength of paper was determined by TAPPI T494 while the burst strength was determined by TAPPI T403.

The blank test was conducted in the same way with the only exception that no dry strength agent was added.

The dosage of dry strength agent referred to the amount of active ingredient in relation to the oven dry pulp. The ratio between two components was related to the weight ratio of the active ingredients. In this example, the dosage of the dry strength agent was about 6 kg/t and two components were added simultaneously.

TABLE 1

| | C1/A1 | Internal bond kg*cm/in$^2$ | Dry tensile strength N*m/g | Burst strength kPa*m$^2$/g |
|---|---|---|---|---|
| Blank | | 0.93 | 29.69 | 2.33 |
| C1 | | 1.35 | 38.34 | 2.95 |
| A1 | | 1.19 | 34.20 | 2.59 |
| C1 + A1 | 4/1 | 1.35 | 36.61 | 2.89 |
| C1 + A1 | 2/1 | 1.45 | 38.79 | 2.96 |
| C1 + A1 | 1/1 | 1.43 | 40.90 | 3.11 |
| C1 + A1 | 1/2 | 1.56 | 40.77 | 3.33 |

As seen from Table 1, paper strength including Internal bond, dry strength and burst strength could be improved obviously by the combined use of C1 and A1 compared with using C1 or A1 alone, and the higher proportion of the A1 in the combination, the better of the strength increase.

Example 2

First component: C1 in accordance with Example 1.

Second component: amphoteric copolymer formed from acrylamide, N-(2-dimethylaminoethyl) acrylamide, diallyldimethyl ammonium chloride, sodium acrylate and sodium allylsulfonate in a molar ratio of 90:8:1:0.5:0.5, with the number average molecular weight of about 1,000,000 g/mol and total charge density of about 0.51 meq/g, which was referred to as A2.

The pulp slurry as used had the following composition: long fiber (NBKP)/short fiber (LBKP)=3/7. No chemical agents but only dry strength agent were added into the pulp slurry. When using the dry strength agent composition, the weight ratio of two components was 1:1 (C1:A2). Other operations were the same as Example 1. The results were listed in Table 2.

TABLE 2

| | Dosage kg/t | Internal bond kg*cm/in$^2$ | Dosage kg/t | Internal bond kg*cm/in$^2$ | Feeding manner |
|---|---|---|---|---|---|
| Blank | 0 | 0.60 | — | — | — |
| C1 | 2 | 0.73 | 4 | 0.81 | — |
| A2 | 2 | 0.75 | 4 | 0.83 | — |
| C1 + A2 | 2 | 0.80 | 4 | 0.93 | in sequence |
| C1 + A2 | 2 | 0.82 | 4 | 0.92 | Co-feeding |
| C1 + A2 | 2 | 0.80 | 4 | 0.96 | premixing |

As seen from Table 2, C1 used in combination with A2 showed better internal bond than using C1 or A2 alone, no matter how the feeding manner was.

Example 3

First component: Copolymer of diallyl amine and acrylamide (referred to as C2) with number average molecular weight of about 500,000 g/mol and cationic charge density of about 1.8 meq/g, wherein the molar ratio of diallyl amine and acrylamide is 15:85.

Second component: A2 in accordance with Example 2.

Two components were premixed in a weight ratio of 1:1 and then added into the pulp slurry. Other operations were the same as Example 2. The results were listed in Table 3.

TABLE 3

| | Dosage kg/t | Internal bond kg*cm/in$^2$ | Dosage kg/t | Internal bond kg*cm/in$^2$ |
|---|---|---|---|---|
| Blank | 0 | 1.3 | — | — |
| C2 | 2 | 1.65 | 4 | 1.73 |
| A2 | 2 | 1.62 | 4 | 1.76 |
| C2 + A2 | 2 | 1.66 | 4 | 1.88 |

As seen from Table 3, C2 used in combination with A2 showed much higher internal bond than using C2 or A2 alone.

Example 4

First component: C1 in accordance with Example 1.

Second component: polyvinyl alcohol (PVA), available on the market with the number average molecular weight of about 50,000 to 300,000 g/mol.

Two components were mixed in a weight ratio of 2:1. Other operations were the same as Example 1. The results were listed in Table 4.

TABLE 4

| | Dosage kg/t | Internal bond kg*cm/in$^2$ | Dosage kg/t | Internal bond kg*cm/in$^2$ |
|---|---|---|---|---|
| blank | 0 | 0.87 | — | — |
| C1 | 2 | 1.08 | 4 | 1.31 |
| PVA | 2 | 1.12 | 4 | 1.13 |
| C1 + PVA | 2 | 1.41 | 4 | 1.48 |

As seen from Table 4, C1 used in combination with PVA can provide higher internal bond than using either alone.

Example 5

First component: C1 in accord with Example 1.

Second component: Carboxymethyl Cellulose, CMC, available on the market, which is in form of white or pale yellow floccular fiber powder or white powder and soluble in water forming the transparent solution with viscosity.

Two components were mixed in a weight ratio of 1:1. Other operations were the same as Example 1. The results were listed in Table 5.

TABLE 5

| | Dosage kg/t | Internal bond kg*cm/in$^2$ | Dosage kg/t | Internal bond kg*cm/in$^2$ |
|---|---|---|---|---|
| Blank | 0 | 0.87 | — | — |
| C1 | 2 | 1.08 | 4 | 1.31 |

TABLE 5-continued

| | Dosage kg/t | Internal bond kg*cm/in$^2$ | Dosage kg/t | Internal bond kg*cm/in$^2$ |
|---|---|---|---|---|
| CMC | 2 | 1.07 | 4 | 1.14 |
| C1 + CMC | 2 | 1.31 | 4 | 1.36 |

As seen from Table 5, C1 used in combination with CMC showed higher internal bond enhancement than using each of them alone.

Example 6

First component: C2 in accordance with Example 3.

Second component: glyoxalated anionic copolymer of acrylic acid and acrylamide with the number average molecular weight of about 500,000 g/mol and anionic charge density of about 0.6 meq/g, which was referred to as A1G.

The pulp slurry as used had the following composition: 20% of bleached chemi-thermomechanical pulp (BCTMP), 65% of alkaline peroxide mechanical pulp (APMP) and 15% of Broke.

The following chemical agents were added into the pulp in sequence: dosage of the dry strength agent is listed in Table 6, the retention aid the copolymer of diallyldimethyl ammonium chloride with acrylamide (0.5 kg/t) and diatomite obtained from Shengzhou Huali Co. (2 kg/t). When using the dry strength agent composition as the dry strength agent, the weight ratio of two components C2:A1G was 5:2. Other operations were the same as Example 1. The results were listed in Table 6.

TABLE 6

| | Dosage kg/t | Internal bond kg*cm/in$^2$ | Dosage kg/t | Internal bond kg*cm/in$^2$ |
|---|---|---|---|---|
| Blank | 0 | 0.9 | — | — |
| C2 | 2 | 1.06 | 4 | 1.11 |
| A1G | 2 | 0.98 | 4 | 1.03 |
| C2 + A1G | 2 | 1.24 | 4 | 1.63 |

As seen from Table 6, the combined use of C2 and A1G provided higher internal bond increase than using either C2 or A1G alone.

Example 7

Control test: using the dry strength agent composition consisting of two components, one of which was C1 in accordance with Example 1 and the other of which was glyoxalated cationic copolymer of diallyldimethyl ammonium chloride and acrylamide in a molar ratio of 12:88 with the charge density of about 0.3 meq/g and number average molecular weight of about 500,000 g/mol.

Inventive test: using the dry strength agent composition consisting of two components, one of which was C1 in accordance with Example 1 and the other of which was A1G in accordance with Example 6.

Other operations were the same as Example 2. The results were listed in Table 7.

TABLE 7

| | Dosage kg/t | Dry tensile strength N*m/g | Dosage kg/t | Dry tensile strength N*m/g |
|---|---|---|---|---|
| Control test | 1 | 37.12 | 2 | 39.49 |
| Inventive test | 1 | 40.54 | 2 | 41.46 |

As seen from Table 7, the inventive test can lead to the much better dry strength performance than the control test.

Example 8

This final example relates to FIG. 1 and shows the amine dry strength chemisty/anionic polymer combination performing better than a standard cationic dry strength chemistry/anionic polymer combination. As can be seen from FIG. 1, there is a clear benefit to the amine and anionic combination versus the combination of cationic polymer or starch with an anionic polymer. In FIG. 1, the amine-containing polymer was the same as C1 as described above and the anionic polymer was A1G.

What is claimed is:

1. A dry strength agent composition comprising a first component and a second component, the first component comprising an amine-containing cationic polymer and the second component comprising a member selected from the group consisting of an anionic polymer, an amphoteric polymer, and any combination thereof, wherein the amine-containing cationic polymer includes a polymer with randomly distributed amine-based monomer repeating units derived from at least one of the following structures or a salt thereof:

I

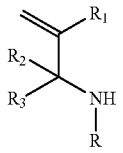

II

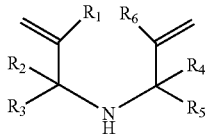

wherein R represents hydrogen or $C_{1-20}$ alkyl; $R_1$, $R_2$, $R_3$, $R_4$, $R_5$, $R_6$ are independently selected from hydrogen, $C_{1-20}$ alkyl, or $C_{1-20}$ alkoxylalkyl.

2. The dry strength agent composition according to claim 1, wherein at least about 0.10 to 99 mol % of monomers of the amine-containing polymer are secondary amine-containing vinyl- or allyl-monomers.

3. The dry strength agent composition according to claim 1, wherein the amine-based monomer is diallyl amine as represented by structure II.

4. The dry strength agent composition according to claim 1, wherein the cationic amine-containing polymers comprise at least one vinyl addition monomer selected from the group consisting of a non-ionic monomer, a cationic monomer, and any combination thereof.

5. The dry strength agent composition according to claim 4, wherein the non-ionic monomer is selected from acrylamide or methacrylamide.

6. The dry strength agent composition according to claim 4, wherein the cationic monomer is selected from the group consisting of diallyldimethyl ammonium chloride, N-(3-dimethylaminopropyl)acrylamide, N-(3-dimethylaminopropyl)methacrylamide, N-(3-dimethylaminoethyl)acrylamide, N-(3-dimethylaminoethyl)methacrylamide, trimethyl-2-acryloyloxyethyl ammonium chloride, trimethyl-2-methacryloyloxyethyl ammonium chloride, 2-(dimethylamino) ethyl acrylate, 2-(dimethylamino)ethyl methacrylate, and any combination thereof.

7. The dry strength agent composition according to claim 1, wherein the amine-containing polymers are not obtained from Hoffmann degradation and contain no polyethylene amine units.

8. The dry strength agent composition according to claim 1, wherein the anionic polymers of the second component are acrylamide copolymers formed by one or more acrylamide monomers and one or more anionic monomers.

9. The dry strength agent composition according to claim 8, wherein the anionic monomers are selected from acrylic acid, methacrylic acid, allyl sulfonic acid, methyl allylsulfonic acid, 1-acrylamido-2-methyl-1-propane sulfonic acid, corresponding salts thereof, and any combination thereof.

10. The dry strength agent composition according to claim 1, wherein the amphoteric polymers of the second component are acrylamide copolymers formed by one or more acrylamide monomers, one or more cationic monomers and one or more anionic monomers.

11. The dry strength agent composition according to claim 10, wherein the cationic monomers are one or more selected from the group consisting of methacryloyloxyethyl trimethylammonium chloride, acryloyloxyethyl trimethylammonium chloride, methacryloyloxyethyl dimethylbenzyl ammonium chloride, acryloyloxyethyl dimethylbenzyl ammonium chloride, (3-acrylamidopropyl)trimethylammonium chloride, methacrylamidopropyl trimethylammonium chloride, 3-acrylamido-3-methylbutyl trimethylammonium chloride, 2-vinyl pyridine, 2-(dimethylamino)ethyl methacrylate, 2-(dimethylamino)ethyl acrylate, diallyl amine, triallyl amine, diallyl dimethyl ammonium chloride, N-(3-dimethylaminopropyl)acrylamide, N-(3-dimethylaminopropyl)methacrylamide, N-(3-dimethylaminoethyl)acrylamide, N-(3-dimethylaminoethyl)methacrylamide, trimethyl-2-acryloyloxyethyl ammonium chloride, trimethyl-2-methacryloyloxyethyl ammonium chloride, 2-(dimethylamino) ethyl acrylate, 2-(dimethylamino)ethyl methacrylate, and any combination thereof.

12. The dry strength agent composition according to claim 10, wherein the anionic monomers are selected from acrylic acid, methacrylic acid, allyl sulfonic acid, methyl allylsulfonic acid, 1-acrylamido-2-methyl-1-propane sulfonic acid, corresponding salts thereof, and any combination thereof.

13. The dry strength agent composition according to claim 1, wherein the second component is crosslinked with a dialdehyde compound.

14. The dry strength agent composition according to claim 1, wherein the weight ratio between the first component and the second component ranges from about 1:99 to 99:1.

15. The dry strength agent composition according to claim 1, wherein the amine-containing cationic polymer is a copolymer comprising diallylamine and (meth)acrylamide.

16. A dry strength agent composition comprising a first component and a second component, the first component comprising an amine-containing cationic polymer and the second component comprising a member selected from the group consisting of an anionic polymer, an amphoteric polymer, and any combination thereof, wherein the anionic polymers of the second component are acrylamide copolymers formed by one or more acrylamide monomers and one or more anionic monomers, wherein the anionic monomers are selected from acrylic acid, methacrylic acid, allyl sulfonic acid, methyl allylsulfonic acid, 1-acrylamido-2-methyl-1-propane sulfonic acid, corresponding salts thereof, and any combination thereof.

17. A dry strength agent composition comprising a first component and a second component, the first component comprising an amine-containing cationic polymer and the second component comprising a member selected from the group consisting of an anionic polymer, an amphoteric polymer, and any combination thereof, wherein the amphoteric polymers of the second component are acrylamide copolymers formed by one or more acrylamide monomers, one or more cationic monomers and one or more anionic monomers, wherein the cationic monomers are one or more selected from the group consisting of methacryloyloxyethyl trimethylammonium chloride, acryloyloxyethyl trimethylammonium chloride, methacryloyloxyethyl dimethylbenzyl ammonium chloride, acryloyloxyethyl dimethylbenzyl ammonium chloride, (3-acrylamidopropyl)trimethylammonium chloride, methacrylamidopropyl trimethylammonium chloride, 3-acrylamido-3-methylbutyl trimethylammonium chloride, 2-vinyl pyridine, 2-(dimethylamino)ethyl methacrylate, 2-(dimethylamino)ethyl acrylate, diallyl amine, triallyl amine, diallyl dimethyl ammonium chloride, N-(3-dimethylaminopropyl)acrylamide, N-(3-dimethylaminopropyl)methacrylamide, N-(3-dimethylaminoethyl) acrylamide, N-(3-dimethylaminoethyl) methacrylamide, trimethyl-2-acryloyloxyethyl ammonium chloride, trimethyl-2-methacryloyloxyethyl ammonium chloride, 2-(dimethylamino)ethyl acrylate, 2-(dimethylamino)ethyl methacrylate, and any combination thereof.

18. A method for enhancing the dry strength of paper in a papermaking process, comprising:

(a) providing a pulp slurry;

(b) providing the dry strength agent composition according to claim 1; and (c) adding the dry strength agent composition into the pulp slurry to obtain a paper stock.

19. The method according to claim 18, wherein the dry strength agent composition is used in an amount from about 0.01 to 50 kg/t, based on active ingredients.

20. The method according to claim 18, wherein the first and second components are added separately into the pulp slurry in any sequence or wherein the first and second components are added together into the pulp slurry after premixing.

* * * * *